US009700128B2

(12) United States Patent
Kennedy et al.

(10) Patent No.: US 9,700,128 B2
(45) Date of Patent: Jul. 11, 2017

(54) ORAL CARE SYSTEM

(71) Applicant: COLGATE-PALMOLIVE COMPANY, New York, NY (US)

(72) Inventors: Sharon Kennedy, Randallstown, MD (US); Christine Boyke, Somerset, NJ (US); Eduardo Jimenez, Manalapan, NJ (US); James R. Brown, Edison, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 65 days.

(21) Appl. No.: 14/649,287

(22) PCT Filed: Dec. 4, 2012

(86) PCT No.: PCT/US2012/067668
§ 371 (c)(1),
(2) Date: Jun. 3, 2015

(87) PCT Pub. No.: WO2014/088547
PCT Pub. Date: Jun. 12, 2014

(65) Prior Publication Data

US 2015/0327667 A1 Nov. 19, 2015

(51) Int. Cl.
*B65D 1/04* (2006.01)
*A46B 11/00* (2006.01)
(Continued)

(52) U.S. Cl.
CPC ..... *A46B 11/0024* (2013.01); *A46B 11/0065* (2013.01); *A46B 11/0079* (2013.01);
(Continued)

(58) Field of Classification Search
CPC ..... B65D 1/04
(Continued)

(56) References Cited

U.S. PATENT DOCUMENTS 1,522,246 A 1/1925 Jefferson
1,699,532 A 1/1929 Hopkins
(Continued)

FOREIGN PATENT DOCUMENTS

CN 2722709 9/2005
CN 102655787 9/2012
(Continued)

OTHER PUBLICATIONS

International Search Report and the Written Opinion of the International Searching Authority issued in International Patent Application PCT/US2012/067668 mailed Aug. 5, 2013.
(Continued)

*Primary Examiner* — David Walczak
*Assistant Examiner* — Joshua Wiljanen

(57) ABSTRACT

An oral care system including a toothbrush and a dispenser that is detachably coupled thereto. In one aspect, the invention can be an oral care system comprising: a toothbrush comprising a handle, a head and a plurality of tooth cleaning elements extending from the head; and a dispenser detachably coupled to the toothbrush, the dispenser comprising a housing, a first reservoir chamber disposed in the housing containing a first oral care material, and a second reservoir chamber disposed in the housing containing a second oral care material, the second oral care material different than the first oral care material.

18 Claims, 9 Drawing Sheets

(51) Int. Cl.

| | |
|---|---|
| ***A46B 15/00*** | (2006.01) |
| ***B01F 7/00*** | (2006.01) |
| ***B01F 13/00*** | (2006.01) |
| ***B01F 15/00*** | (2006.01) |
| ***B05C 17/005*** | (2006.01) |

(52) U.S. Cl.
CPC ..... *A46B 15/0061* (2013.01); *B01F 7/00216* (2013.01); *B01F 7/00416* (2013.01); *B01F 13/0023* (2013.01); *B01F 15/0087* (2013.01); *B01F 15/00506* (2013.01); *B05C 17/00553* (2013.01); *A46B 2200/1066* (2013.01); *B05C 17/00556* (2013.01); *B65D 1/04* (2013.01)

(58) Field of Classification Search
USPC ... 222/94, 135, 138, 139, 142, 145.1, 145.5, 222/145.6
See application file for complete search history.

(56) References Cited

U.S. PATENT DOCUMENTS

| | | | | |
|---|---|---|---|---|
| 2,939,610 | A | 6/1960 | Castelli et al. | |
| 3,608,709 | A | 9/1971 | Pike | |
| 3,715,806 | A | 2/1973 | McNickle et al. | |
| 4,046,288 | A | 9/1977 | Bergman | |
| 4,211,341 | A | 7/1980 | Weyn | |
| 4,687,663 | A | 8/1987 | Schaeffer | |
| 4,865,231 | A | 9/1989 | Wiercinski | |
| 4,950,237 | A | 8/1990 | Henault et al. | |
| 5,137,178 | A | 8/1992 | Stokes et al. | |
| 5,174,475 | A | 12/1992 | Day et al. | |
| 5,403,105 | A * | 4/1995 | Jameson | A46B 11/002 401/176 |
| 5,849,241 | A | 12/1998 | Connan | |
| 5,927,550 | A | 7/1999 | Mack et al. | |
| 5,954,213 | A | 9/1999 | Gerhart et al. | |
| 5,954,234 | A | 9/1999 | Connan et al. | |
| 6,216,915 | B1 | 4/2001 | Harman et al. | |
| 6,250,346 | B1 | 6/2001 | Castillo | |
| 6,358,494 | B1 * | 3/2002 | Aoki | A61K 8/21 222/94 |
| 6,412,660 | B1 | 7/2002 | Bouix et al. | |
| 6,439,885 | B2 | 8/2002 | Antler | |
| 6,752,264 | B2 | 6/2004 | Versluys | |
| 6,845,884 | B2 | 1/2005 | Chan et al. | |
| 6,877,638 | B2 | 4/2005 | Chan et al. | |
| 7,237,974 | B2 * | 7/2007 | Pfenniger | A46B 15/0061 401/118 |
| D636,940 | S | 4/2011 | Acierto et al. | |
| 8,052,016 | B2 | 11/2011 | Wang | |
| 9,138,046 | B2 * | 9/2015 | Jimenez | A46B 11/0006 |
| 9,144,298 | B2 * | 9/2015 | Fattori | A46B 11/0041 |
| 9,398,803 | B2 * | 7/2016 | Jimenez | A46B 11/0024 |
| 2005/0036821 | A1 | 2/2005 | Pfenniger et al. | |
| 2005/0072801 | A1 | 4/2005 | Chadfield et al. | |
| 2005/0184090 | A1 | 8/2005 | DeJonge | |
| 2006/0067783 | A1 | 3/2006 | Tsaur | |
| 2007/0119861 | A1 | 5/2007 | Bhagwat | |
| 2007/0187429 | A1 | 8/2007 | Farahmand | |
| 2008/0038041 | A1 | 2/2008 | Desson et al. | |
| 2008/0128426 | A1 | 6/2008 | Rick et al. | |
| 2008/0206165 | A1 | 8/2008 | Mitra et al. | |
| 2008/0311057 | A1 | 12/2008 | Larsen et al. | |
| 2010/0163441 | A1 | 7/2010 | Kim | |
| 2011/0272379 | A1 | 11/2011 | Eghbaly | |
| 2012/0275843 | A1 | 11/2012 | Jimenez et al. | |

FOREIGN PATENT DOCUMENTS

| | | |
|---|---|---|
| DE | 3233366 | 9/1983 |
| JP | H2-279108 | 11/1990 |
| WO | WO 99/04893 | 2/1999 |
| WO | WO2004/092031 | 10/2004 |
| WO | WO2005/110024 | 11/2005 |
| WO | WO2010/087789 | 8/2010 |
| WO | WO2012/026847 | 3/2012 |

OTHER PUBLICATIONS

Written Opinion of the International Preliminary Examining Authority issued in International Patent Application PCT/US2012/067668 mailed Feb. 19, 2015.

* cited by examiner

ORAL CARE SYSTEM

CROSS-REFERENCE TO RELATED PATENT APPLICATIONS

This application is a U.S. national stage application under 35 U.S.C. §371 of PCT Application No. PCT/US2012/067668, filed Dec. 4, 2012, the entirety of which is incorporated herein by reference.

BACKGROUND OF THE INVENTION

Oral care products or agents are applied in different ways. For example, a common technique used for tooth whitening products is to cast an impression of a person's teeth and provide a tray of the shape of this impression. While tray-based systems are suitable, many people do not use them due to the fact that they tend to be uncomfortable and/or awkward. Moreover, in order to use a whitening tray, a user must keep the tray and the required components at hand. This not only requires extra storage space in already cramped bathroom cabinets but also requires that the user remember to use the whitening system. Furthermore, these tray-based systems are not conveniently portable for transport and/or travel.

In addition to difficulties in applying some oral care products, storage is sometimes cumbersome and inconvenient for the user. The oral care product must typically be stored separately from oral care tooth cleaning implements such as a toothbrush since the oral care product package and toothbrush heretofore are generally treated as separate and distinct parts of an oral care regimen. A more portable, compact and convenient way to store oral care products, and to dispense and apply those oral care products to oral surfaces is desired.

BRIEF SUMMARY OF THE INVENTION

Embodiments of the present invention provide an efficient, compact, and portable oral care system that combines an oral care implement such as a toothbrush with an oral care product or agent dispenser in a highly portable housing. Advantageously, such embodiments are especially suited for easy transport and/or travel.

In one embodiment, the invention can be an oral care system comprising: a toothbrush comprising a handle, a head and a plurality of tooth cleaning elements extending from the head; and a dispenser detachably coupled to the toothbrush, the dispenser comprising a housing, a first reservoir chamber disposed in the housing containing a first oral care material, and a second reservoir chamber disposed in the housing containing a second oral care material, the second oral care material different than the first oral care material.

In another embodiment, the invention can be a dispenser comprising: a housing having a first reservoir chamber containing a first oral care material and a second reservoir chamber containing a second oral care material, the second oral care material being different than the first oral care material; a mixing chamber disposed in the housing, a mixing screw disposed within the mixing chamber and having an actuator for rotating the mixing screw; a first delivery port for introducing the first oral care material into the mixing chamber and a second delivery port for introducing the second oral care material into the mixing chamber; a dispensing nozzle for dispensing a mixture of the first and second oral care materials; and wherein rotation of the mixing screw draws the first and second oral care materials into the mixing chamber via the first and second delivery ports respectively and expels the mixture of the first and second oral care materials from the nozzle.

In yet another embodiment, the invention can be a dispenser comprising: a housing having a first reservoir chamber containing a first oral care material and a second reservoir chamber containing a second oral care material; a first nozzle for dispensing the first oral care material from the first reservoir chamber and a second nozzle for dispensing the second oral care material from the second reservoir chamber, the first and second nozzles located on opposite ends of the dispenser; and wherein the first reservoir chamber circumferentially surrounds the second reservoir chamber about a longitudinal axis of the dispenser.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
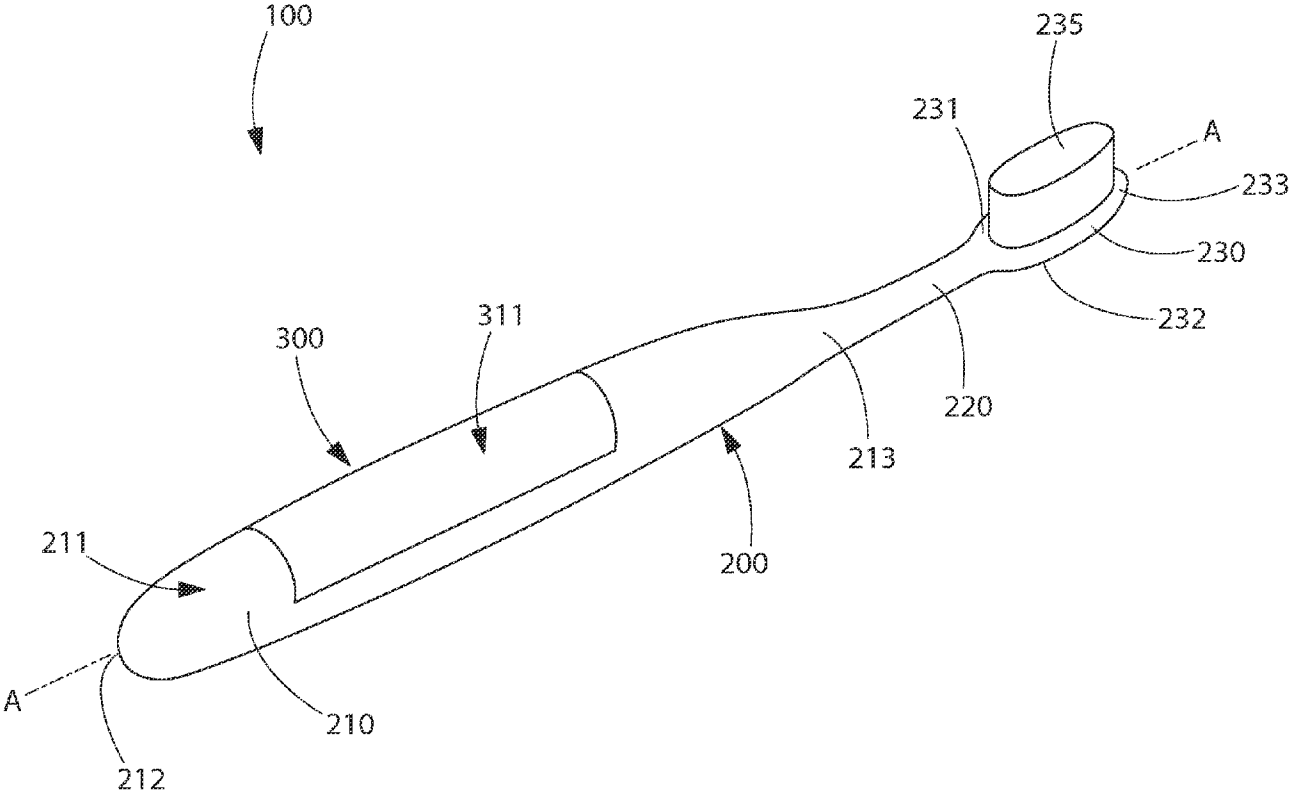
FIG. 1 is a front perspective view of an oral care system including a toothbrush and an oral agent dispenser according to one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Preferred embodiments of the present invention will now be described with respect to one or more possible oral care or treatment systems. Embodiments of the oral care system include a dispenser that may include, without limitation, one or more of the following oral care fluids: tooth whitening, antibacterial, enamel protection, anti-sensitivity, anti-inflammatory, anti-attachment, fluoride, tartar control/protection, flavorant, sensate, colorant and others. However, other embodiments of the present invention may be used to store and dispense any suitable type of oral care fluid and the invention is expressly not limited to any particular oral care system or fluid alone. A more detailed, although still non-exhaustive, listing of possible oral care fluids that may be stored in the dispenser will be provided below.

Referring to FIG. 1, an oral care system 100 is illustrated according to one embodiment of the present invention. The oral care system 100 is a compact readily portable self-contained user-friendly system that comprises all of the necessary components and chemistries necessary for a user to perform a desired oral care treatment routine. As will be described in greater detail below, the oral care system 100 in one exemplary embodiment generally takes the form of a modified toothbrush having a removable dispenser disposed at least partially within its handle. Because the dispenser is located at least partially within the handle of the toothbrush itself, the oral care system 100 is portable for travel, easy to use, and reduces the amount of required storage space. Furthermore, since the toothbrush and dispenser are housed together, the user is less likely to misplace the dispenser and will be more inclined to maintain the oral treatment routine with the dispenser since brushing will remind the user to simply detach and apply the contents of the dispenser.

The oral care system 100 generally comprises a toothbrush 200 and a dispenser 300. While the invention is described herein with respect to the use of a manual toothbrush as one of the two primary components of the oral care system 100, it is to be understood that other alternative oral care implements can be used within the scope of the invention, including a powered toothbrush, a tongue scraper, a gum and soft tissue cleanser, a water pick, an interdental device, a tooth polisher, a specially designed ansate implement having tooth engaging elements specially designed to increase the effect of the active agent in the dispenser on the teeth or any other type of implement that is commonly used for oral care. Thus, it is to be understood that the inventive concepts discussed herein can be applied to any type of oral care implement unless a specific type of oral care implement is specified in the claims.

It is to be understood that the inventive system can be utilized for a variety of intended oral care needs by filling the dispenser 300 with any oral care material, such as an oral care fluid that achieves a desired oral effect. In one embodiment, the oral care material is preferably free of (i.e., is not) toothpaste as the dispenser 300 is intended to augment not supplant the brushing regimen. However, the invention is not to be so limited and in other embodiments the oral care material may be or may include toothpaste. The oral care materials and/or its medium can be selected to complement a toothpaste formula, such as by coordinating flavors, colors, aesthetics, or active ingredients.

In certain embodiments as will be discussed in more detail below, the dispenser 300 contains more than one oral care material. Furthermore, in certain embodiments the various oral care materials are intended to be maintained separately during storage and then mixed within the dispenser 300 immediately prior to application onto a user's teeth and/or oral surfaces. In other embodiments the various oral care materials are intended to be maintained separately during storage and applied separately and/or sequentially onto a user's teeth and/or oral surfaces. In embodiments wherein separate applications of the various oral care materials is desired, the various oral care materials can be applied at different times such that no mixing of the oral care materials occurs, or sequentially such that the various oral care materials are mixed upon application. For example, one formula can contain a whitening ingredient that requires a catalyst. The whitening ingredient would be applied through a first applicator, and then the catalyst would be applied through a second applicator. Upon application of the catalyst, the catalyst will contact the whitening ingredient and accelerate the tooth whitening. Various embodiments of dispensers that are capable of achieving mixing immediately prior to application, during application, or not at all for separate application will be discussed in more detail below.

The oral care materials contained within the dispenser 300 may be a measured amount of a semi-viscous, yet flowable, aesthetically pleasing, pleasant tasting oral care composition that is dosed or metered through the dispenser 300 and delivered directly into a user's oral cavity or onto the cleaning elements of the oral care implement 200. The dispenser 300 may contain pastes, gels, rinses, foams, scrubbers, solids, liquids and/or aerosols under compressed air. In some embodiments, the composition has the capability and potential of containing and delivering active ingredients, such as Fluoride, Arginine, Triclosan, or the like, while further providing potential cleaning, stain-removal, whitening of the teeth surface with the incorporation of chemical agents such as hydrogen peroxide, or polishing abrasives such as, for example, silica, dicalcium phosphate, precipitated calcium carbonate or the like. The composition also has the capability of delivering consumer perceivable visual signals via unique colorants, shapes, stripes, sparkles, extruded forms, etc, while further delivering consumer perceivable sensory signals delivered via unique flavors, sweeteners, sensates, or the like.

The oral care materials contained within the dispenser 300 are materials that provide oral health benefits to a user upon contact with a user's oral cavity. In one embodiment, the oral care materials are fluidic materials. For example, in certain embodiments the oral care materials include a mouthwash solution that cleans the oral surfaces when applied thereto and provides the user with breath freshening benefits. In other embodiments, the oral care materials include a tooth cleaning solution, such as a dentifrice. Of course, the oral care materials are not to be in any way limiting of the present invention and may include fluids having active or inactive agents that deliver therapeutic, cosmetic, experiential and/or sensorial benefits to a consumer during a tooth, soft tissue, tongue or interdental cleaning regimen. Specifically, the oral care material can be an anti-sensitivity agent, fluoride, a tartar protection agent, an antibacterial agent, an oxidative or whitening agent, an enamel strengthening or repair agent, a tooth erosion preventing agent, a tooth sensitivity ingredient, a gum health active, a nutritional ingredient, a tartar control or anti-stain ingredient, an enzyme, a sensate ingredient, a flavor or flavor ingredient, a breath freshening ingredient, an oral malodor reducing agent, an anti-attachment agent or sealant, a diagnostic solution, an occluding agent, a dry mouth relief ingredient, a catalyst to enhance the activity of any of these agents, colorants or aesthetic ingredients, arginine bicarbonate, chlorohexidine, triclosan, CPC, zinc oxide and combinations thereof. As noted above, in certain embodiments the oral care materials or at least one of the oral care materials is free of a dentifrice as the oral care fluid is intended to supplement traditional brushing of the teeth rather than supplant it.

The toothbrush 200 generally comprises a handle portion 210, a neck portion 220 and a head portion 230. The handle 210 provides the user with a mechanism by which he/she can readily grip and manipulate the toothbrush 100. The handle 210 may be formed of many different shapes, sizes, materials and a variety of manufacturing methods that are well-known to those skilled in the art, so long as it can be coupled to the dispenser 300 as described in detail below. If desired, the handle 210 may include a suitable textured grip made of soft elastomeric material covering a portion of or the entirety of its outer surface. The handle 210 can be a single or multi-part construction. The handle 210 extends from a proximal end 212 to a distal end 213 along a longitudinal axis A-A.

The handle 210 transitions into the neck 220 at the distal end 213. While the neck 220 generally has a smaller transverse cross-sectional area than the handle 210, the invention is not so limited in all embodiments. The neck 220 is merely the transition region between the handle 210 and the head 230 and can conceptually be considered as a portion of the handle 210. In this manner, the head 230 is connected to the distal end 213 of the handle 210 (via the neck 220).

The head 230 and the handle 220 of the toothbrush 200 are preferably formed as a single unitary structure using a molding, milling, machining or other suitable process. However, in other embodiments, the handle 210 and the head 230 may be formed as separate components which are operably connected at a later stage of the manufacturing process by any suitable technique known in the art, including without limitation thermal or ultrasonic welding, a tight-fit assembly, a coupling sleeve, adhesion, or fasteners. Whether the head 230 and handle 210 are of a unitary or multi-piece construction (including connection techniques) is not limiting of the present invention, unless specifically stated. In some embodiment of the invention, the head 230 may be detachable (and replaceable) from the handle 210 using techniques well-known in the art.

In certain embodiments, each of the handle 210, the neck 220 and the head 230 are formed of a rigid material, such as for example without limitation polymers and copolymers of ethylene, propylene, butadiene, vinyl compounds and polyesters such as polyethylene terephthalate. Of course, the invention is not to be so limited in all embodiments and in certain other embodiments the handle 210 and/or the neck 220 and/or the head 230 can be formed of other materials. Furthermore, as will be understood from the description below, in certain embodiments the dispenser 300 is also formed of the same or a similar rigid material that is used to form the toothbrush 200. However, the materials that are used to form the dispensers 300 and the relative properties, such as rigidity, flexibility, compressibility, and the like, will be discussed in more detail below.

The head 230 generally comprises a front surface 231, a rear surface 232 and a peripheral surface 233. The front surface 231 and the rear surface 232 of the head 230 can take on a wide variety of shapes and contours, none of which are limiting of the present invention. For example, the front and rear surfaces 231, 232 can be planar, contoured or combinations thereof. Moreover, if desired, the rear surface 232 may also comprise additional structures for oral cleaning or tooth engagement, such as a soft tissue cleaner or a tooth polishing structure. An example of a soft tissue cleaner is an elastomeric pad comprising a plurality of nubs and or ridges. Without intending to be limited, an example of a suitable elastomeric soft tissue cleaner that may be used with the present invention and positioned on the rear surface 232 of the head 230 is disclosed in U.S. Pat. No. 7,143,462, issued Dec. 5, 2006 to the assignee of the present application, the entirety of which is hereby incorporated by reference. An example of a tooth polishing structure can be an elastomeric element, such as a prophy cup(s) or elastomeric wipers. Furthermore, while the head 230 is normally widened relative to the neck 220 of the handle 210, it could in some constructions simply be a continuous extension or narrowing of the handle 210.

The front surface 231 of the head 230 comprises a collection of oral cleaning elements such as tooth engaging elements 235 extending therefrom for cleaning and/or polishing contact with an oral surface and/or interdental spaces. While the collection of tooth engaging elements 235 is preferably suited for brushing teeth, the collection of tooth cleaning elements 235 can also be used to polish teeth instead of or in addition to cleaning teeth. As used herein, the term "tooth engaging elements" is used in a generic sense to refer to any structure that can be used to clean, polish or wipe the teeth and/or soft oral tissue (e.g. tongue, cheek, gums, etc.) through relative surface contact. Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material preferably has a hardness property in the range of A8 to A25 Shore hardness. One preferred elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth engaging elements 235 of the present invention can be connected to the head 230 in any manner known in the art. For example, staples/anchors, in-mold tufting (IFT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

The toothbrush 200 and the dispenser 300 are non-unitary separate structures that are specially designed to be non-fixedly secured together when in an assembled or storage state and completely separated from one another when in a disassembled or application state. The toothbrush 200 and the dispenser 300 are illustrated in the storage state in FIG. 1 and in the application state in FIG. 2. When in the storage state, the dispenser 300 forms a portion of the handle 210 of the toothbrush 200, and when in the application state the dispenser 300 is separated from the handle 210 of the toothbrush 200 and ready to be used to apply an oral care material to a user's oral cavity or directly to the tooth cleaning elements 235 on the head 230 of the toothbrush 200. The dispenser 300 can be manipulated and moved between the storage state (FIG. 1) in which the dispenser is docked in the toothbrush handle portion 210 and the application state (FIG. 2) in which the dispenser 300 is removed from the handle portion 210 by the user as desired. The dispenser docking system for nesting and disengagement of the dispenser 300, and the relevant structural elements of the toothbrush 200 and dispenser 300 comprising the docking system, will be described in greater detail below.

As noted above, the dispenser 300 is detachably coupled to the toothbrush 200. When the dispenser 300 is coupled to the toothbrush 200, a portion of the dispenser 300 forms a portion of an outer surface 211 of the handle 210. More specifically, when the dispenser 300 is coupled to the toothbrush 200, an outer surface 311 of the dispenser 300 is flush with the outer surface 211 of the handle 210 to form a continuous outer surface that is comfortable for a user to grip during use of the toothbrush 200. In the exemplified embodiment, the dispenser 300 is coupled to a front surface 214 of the handle 210 of the toothbrush 200. However, the invention is not to be so limited in all embodiments and in certain other embodiments the dispenser 300 can be coupled to a rear surface of the handle 210 or to side surfaces of the handle 210. In other embodiments, the handle 210 of the toothbrush 200 may form a hollow internal cavity for storage of the dispenser 300 therein. The exact location of the attachment between the dispenser 300 and the handle 210 of the toothbrush 200 is not to be limiting of the present invention in all embodiments. Furthermore, in certain other embodiments the dispenser 300 may be fully housed within the handle 210 when the dispenser 300 is coupled to the toothbrush 200. In such embodiments, the dispenser 300 does not form a part of the outer gripping surface of the handle 210, but rather is disposed within an inner cavity of the handle 210 during storage.

Figure 2:
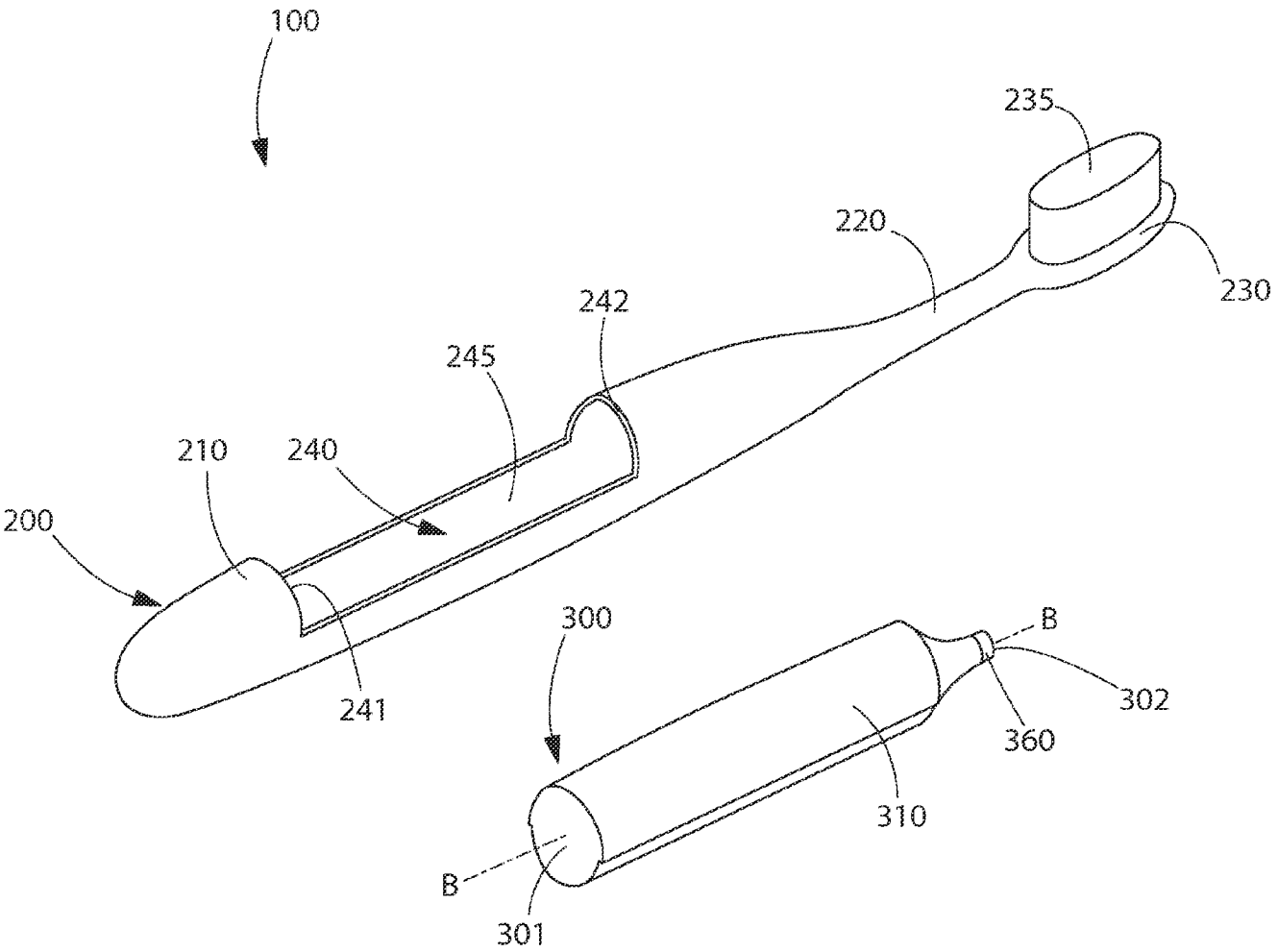
FIG. 2 is an exploded view of the oral care system of FIG. 1 wherein the oral agent dispenser is detached from the toothbrush.

Referring to FIG. 2, the oral care system 100 is illustrated with the dispenser 300 detached from the handle 210 of the toothbrush 200. The handle 210 of the toothbrush 200 includes a cavity 240 within which the dispenser 300 nests when the dispenser 300 is detachably coupled to the toothbrush 200. The cavity 240 of the handle 210 of the toothbrush 200 is sized and shaped to accommodate the dispenser 300. A longitudinally elongated opening 245 is formed into the handle 210 that leads to the cavity 240 adapted for removably receiving the dispenser 300 therein. Depending upon the relative size of the dispenser 300, the opening can be formed along a substantial longitudinal portion of the handle 210. In certain embodiments, the cavity 240 may be considered a depression. As discussed above, in the exemplified embodiment when the dispenser 300 is detachably coupled to the handle 210 of the toothbrush 200, the dispenser 300 nests within the cavity 240 so that the outer surface 311 of the dispenser 300 forms a portion of the outer surface 211 of the handle 200.

The dispenser 300 generally comprises a housing 310 and a nozzle 360. Furthermore, the dispenser 300 extends along a longitudinal axis B-B from a proximal end 301 to a distal end 302, the distal end 302 being the dispensing end of the dispenser 300. When the dispenser 300 is detachably coupled to the handle 210 of the toothbrush 200 as depicted in FIG. 1, the proximal end 301 of the dispenser 300 is adjacent a bottom end 241 of the cavity 240 and the nozzle 360, which includes the distal end 302 of the dispenser 300, protrudes into the cavity 240 beyond a top end 242 of the cavity 240. In this manner, the nozzle 360 of the dispenser 300 is completely housed within the handle 210 of the toothbrush 200 when the dispenser 300 is detachably coupled to the handle 210 of the toothbrush 200, thereby providing protection to the nozzle 360 and dispensing ports of the dispenser 300 which will be described in more detail below.

In order to detachably couple the dispenser 300 to the handle 210 of the toothbrush 200, first the nozzle 360 of the dispenser 300 is positioned within the cavity 240 so as to be located axially beyond the top end 242 of the cavity 240 in the direction of the head 230 of the toothbrush 200. Next, the body or housing 310 of the dispenser 300 is pressed into the cavity 240 until the proximal end 301 of the dispenser 300 is adjacent to or abuts against the bottom end 241 of the cavity 240. In the exemplified embodiment, the coupling between the dispenser 300 and the handle 210 of the toothbrush 200 is achieved via a snap fit or an interference fit. However, the invention is not to be so limited in all embodiments and in certain other embodiments the dispenser 300 can be coupled to the handle 210 via other mechanical connections, such as a tight fit assembly, a coupling sleeve, adhesion, fasteners or the like. Furthermore, in other embodiments the dispenser 300 can be snapped into the cavity or depression 240, and then clips or tangs that are affixed to the handle 210 can be used to maintain the dispenser 300 in its stored position attached to the handle 210. The dispenser 300 can be removed from the cavity 240 and thereby detached from the handle 210 of the toothbrush 200 by pulling on the dispenser 300 and the handle 210 in opposite transverse directions. Thus, insertion of the dispenser 300 from the cavity 240 is achieved by transversely inserting the dispenser 300 into the handle 210 for seating and mounting and removal of the dispenser 300 from the cavity 240 is achieved by pulling the dispenser 300 away from the cavity 240 in an opposite transverse direction.

Figure 3:
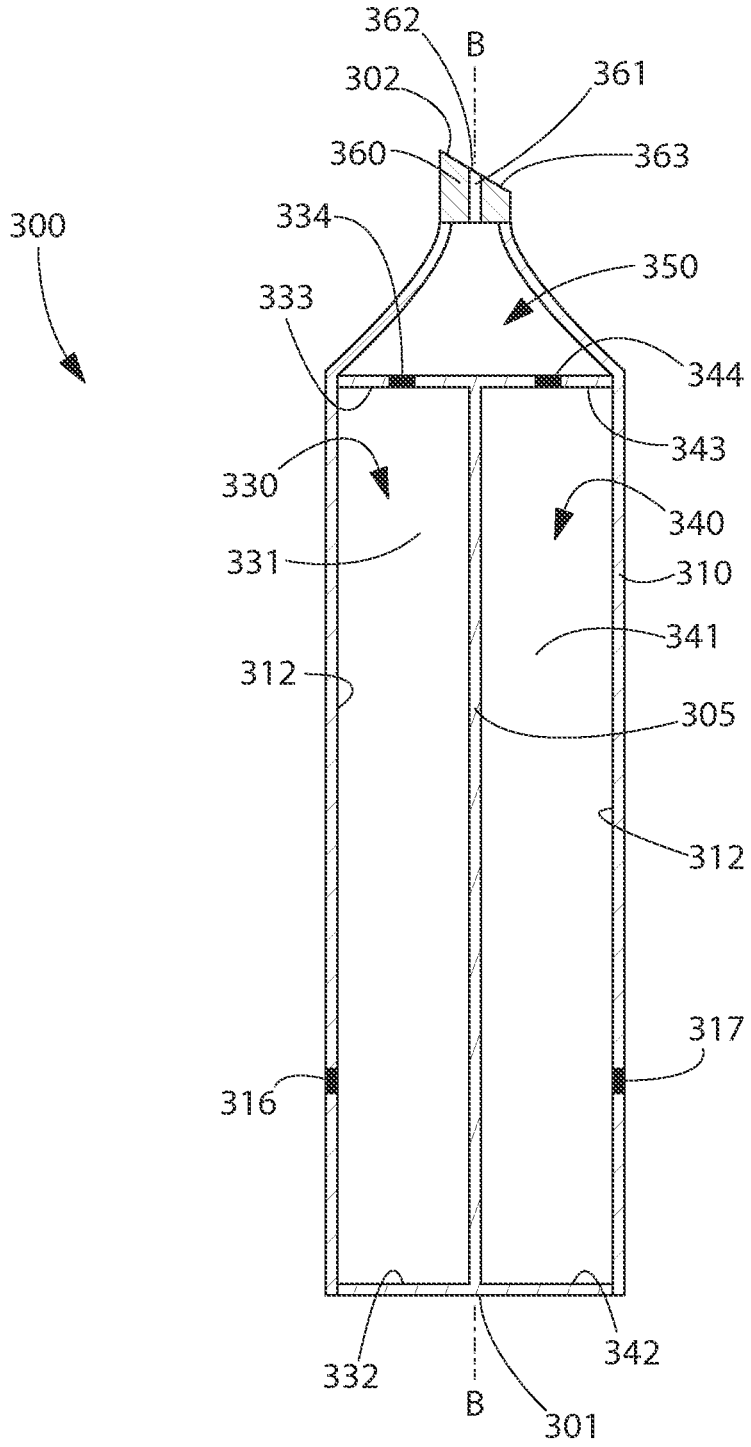
FIG. 3 is a longitudinal cross-sectional view of the oral agent dispenser of FIG. 2 according to a first embodiment of the present invention.
Figure 4A:
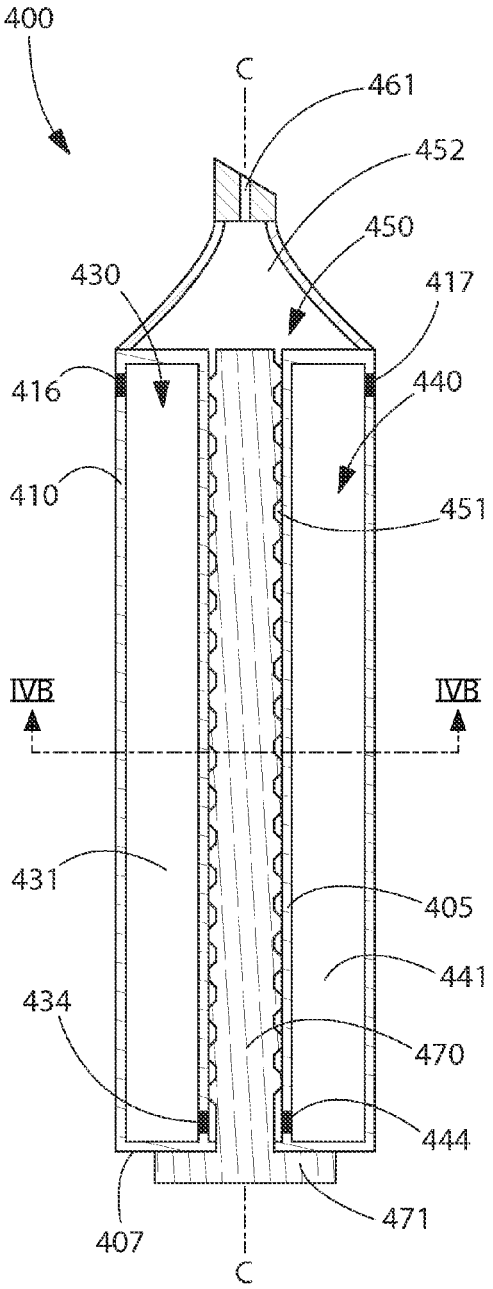
FIG. 4A is a longitudinal cross-sectional view of the oral agent dispenser of FIG. 2 according to a second embodiment of the present invention.
Figure 4B:
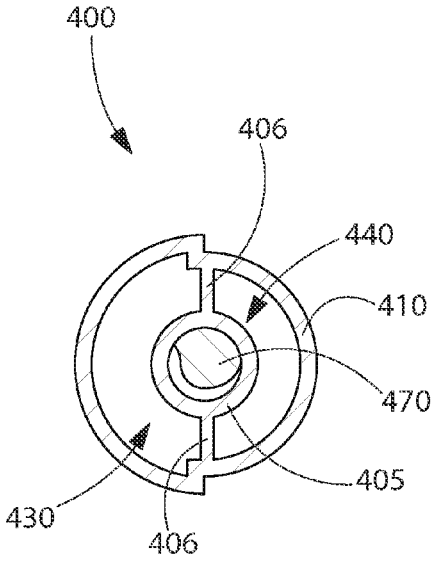
FIG. 4B is a cross-sectional view taken along line IVB-IVB of FIG. 4A.

Referring now to FIG. 3, a first embodiment of a schematic cross-sectional view of the dispenser 300 is illustrated. In accordance with the invention herein described, the dispenser 300 can take on various configurations, particularly with respect to the separate reservoir chambers of the dispenser 300. FIG. 3 illustrates one embodiment of the dispenser 300, and FIGS. 4A and 4B illustrate a second embodiment of a dispenser 400. Each of the first and second embodiments of the dispenser 300, 400 will be discussed in turn below, starting with a description of the embodiment depicted in FIG. 3.

The dispenser 300 extends along the longitudinal axis B-B from the proximal end 301 to the distal end 302. The dispenser 300 comprises the housing 310 which defines an internal cavity. In a general sense, the dispenser 300 comprises the housing 310, a mixing chamber 350 and the nozzle 360. The dispenser 300 is adapted to contain and dispense a mixture of oral care materials onto a target surface in an oral cavity of a user as will be discussed in detail below.

In the exemplified embodiment, the internal cavity includes a first reservoir chamber 330 disposed within the housing 310 and a second reservoir chamber 340 disposed within the housing 310. Thus, the dispenser 300 includes two separate reservoir chambers 330, 340 for containing an oral care fluid. More specifically, in the exemplified embodiment the first reservoir chamber 330 contains a first oral care material 331 and the second reservoir chamber 340 contains a second oral care material 341. In certain embodiments, each of the first and second oral care materials 331, 341 are different. For example without limitation, the first oral care material 331 may be a tooth whitening solution and the second oral care material 341 may be a catalyst. Of course, the invention is not to be so limited and any of the various different types of oral care fluids described herein above can be used as the first and second oral care materials 331, 341, so long as the first and second oral care materials 331, 341 are different from one another. Furthermore, in the dispenser 300 the first and second oral care materials 331, 341 are mixed or combined prior to dispensing, thus in certain embodiments the first and second oral care materials 331, 341 are materials that are intended to be mixed together prior to use.

In certain embodiments, the housing 310 including the first and second reservoir chambers 330, 340 are coupled to the nozzle 360 via a co-molding technique. However, the invention is not to be so limited and in certain other embodiments the housing 310 including the first and second reservoir chambers 330, 340 can be coupled to the nozzle 360 via interference fit, threaded screws (i.e., screwing the housing 310 into a nozzle compartment), or the like. Thus, the attachment can be permanent via co-molding or non-permanent such that the housing 310 and the first and second reservoir chambers 330, 340 can be replaced by a user.

In the exemplified embodiment, the first reservoir chamber 330 is separated from the second reservoir chamber 340 by a longitudinal separator wall 305. Thus, the first and second reservoir chambers 330, 340 extend longitudinally adjacent one another and are isolated from one another by the longitudinal separator wall 305. The separator wall 305 isolates the first reservoir chamber 330 from the second reservoir chamber 340 and prevents mixing of the first oral care material 331 with the second oral care material 341 until a desirable time during dispensing. Thus, in instances where it is undesirable to mix the first and second oral care materials 331, 341 prior to dispensing onto a user's oral cavity, the separator wall 305 provides such separation.

The first reservoir chamber 330 is defined by an inner surface 312 of the housing 310, a floor 332, a ceiling 333 and the separator wall 305. The second reservoir chamber 340 is defined by the inner surface 312 of the housing 210, a floor 342, a ceiling 343 and the separator wall 305. In the exemplified embodiment, the ceiling 333 of the first reservoir chamber 330 and the ceiling 343 of the second reservoir chamber 340 is a single transverse wall that is conceptually divided into the ceiling 333 of the first reservoir chamber 330 and the ceiling 343 of the second reservoir chamber 340 by the separator wall 305. The separator wall 305 extends from the floors 332, 342 of the first and second reservoir chambers 330, 340 to the ceilings 333, 343 of the first and second reservoir chambers 330, 340 thereby completely separating and isolating the first and second reservoir chambers 330, 340 from one another. In the exemplified embodiment, the separator wall 305, the floors 332, 342, and the ceilings 333, 343 are integrally formed. However, the invention is not to be so limited and the various components of the dispenser 300 can be separately formed and later connected using techniques known in the art and described above. Furthermore, the ceiling 333 separates the first reservoir chamber 330 from the mixing chamber 350 and the ceiling 343 separates the second reservoir chamber r340 from the mixing chamber 350.

As noted above, the dispenser 300 further comprises a mixing chamber 350 within which the first and second oral care fluids 331, 341 can be mixed prior to being dispensed into a user's oral cavity. In the exemplified embodiment, the mixing chamber 350 is located in between the dispensing nozzle 360 and the first and second reservoir chambers 330, 340. Stated another way, the mixing chamber 350 is located below the dispensing nozzle 360 and above the first and second reservoir chambers 330, 340. The mixing chamber 350 is in fluid communication with the first and second reservoir chambers 330, 340 to facilitate flow of the first and second oral care materials 331, 341 from the first and second reservoir chambers 330, 340 into the mixing chamber 350 for mixing the first and second oral care materials 331, 341 together prior to dispensing.

To facilitate flow of the first oral care fluid 331 from the first reservoir chamber 330 into the mixing chamber 350, a first delivery port 334 is formed into the ceiling 333 of the first reservoir chamber 330. Similarly, to facilitate flow of the second oral care fluid 341 from the second reservoir chamber 340 into the mixing chamber 350, a second delivery port 344 is formed into the ceiling 343 of the second reservoir chamber 340. Each of the first and second delivery ports 334, 344 comprises a one-way flow controller for preventing backflow of the first and second oral care materials 331, 341 from the mixing chamber 350 into the first and second reservoir chambers 330, 340. Thus, each of the first and second delivery ports 334, 344 are one-way valves, such as for example without limitation, duckbill valves, that enable the first oral care fluid 331 to flow from the first reservoir chamber 330 into the mixing chamber 350 and enable the second oral care fluid 341 to flow from the second reservoir chamber 340 into the mixing chamber 350 while preventing the first and second oral care fluids 331, 341 from flowing back into the first and second reservoir chambers 330, 340 from the mixing chamber 350.

The dispensing nozzle 360 extends from the housing 310 of the dispenser 300 in the axial direction away from the mixing chamber 350. In the exemplified embodiment, the nozzle 360 comprises an applicator that is intended to be pressed against a user's teeth during application of the oral care materials. In such embodiments, the applicator may be formed of an elastomeric material. In certain other embodiments, the applicator of the dispensing nozzle 360 may be constructed of bristles, a porous or sponge material or a fibrillated material. Suitable bristles include any common bristle material such as nylon or PBT. The sponge-like materials can be of any common foam material such as urethane foams. The fibrillated surfaces can be comprised of various thermoplastics. In one embodiment, the fibrillated material will have an essentially planar surface that has a plurality of protruding fibrils up to about 3 millimeter in length. Such a fibrillated surface provides a mini-brush surface. The invention, however, is not so limited and the applicator of the dispensing nozzle 360 can be any type of surface and/or configuration that can apply a viscous substance onto the hard surface of teeth including merely an uncovered opening/orifice. In certain other embodiments, the applicator of the dispensing nozzle 360 can be a rigid plastic or an elastomeric material that extends from the housing 310 and comprises an opening therethrough to facilitate flowing the mixed first and second oral care materials 331, 341 from the mixing chamber 350 to the user's oral cavity. Furthermore, in still other embodiments the dispensing nozzle 360 can be an opening for applying the oral care materials onto a toothbrush or otherwise without including an applicator as described above.

A dispensing passageway 361 for dispensing a mixture of the first and second oral care materials 331, 341 extends through the dispensing nozzle 360 from a top portion of the mixing chamber 350 to an opening 362 in an applicator surface 363 of the dispensing nozzle 360. In the exemplified embodiment, the applicator surface 363 of the dispensing nozzle 360 is slanted or angled to facilitate application of the mixed oral care materials onto a user's teeth and/or other oral surfaces. Of course, the invention is not to be so limited and in certain other embodiments the applicator surface 363 of the dispensing nozzle 360 can be flat and transverse to the longitudinal axis B-B of the dispenser 300.

During use of the dispenser 300, the first and second delivery ports 334, 344 deliver the first and second oral care materials 331, 341 from the first and second reservoir chambers 330, 340 to a bottom portion of the mixing chamber 350. Furthermore, the dispensing passageway 361 dispenses the mixture of the first and second oral care materials 331, 341 from the top portion of the mixing chamber 350 and through the dispensing nozzle 360. Thus, upon entering into the mixing chamber 350, the first and second oral care materials 331, 341 mix together to form a mixture of the first and second oral care materials 331, 341. In this manner, the first and second oral care materials 331, 341 are mixed together just prior to being dispensed onto a user's oral cavity.

In certain embodiments, the housing 310 of the dispenser 300 can be formed of a compressible material so that the first and second oral care materials 331, 341 can be dispensed through the first and second delivery ports 334, 344 by applying pressure to and compressing the housing 310. In such embodiments, the housing 310 comprises a first air port 316 and a second air port 317. The first air port 316 enables air to enter into the first reservoir chamber 330 and the second air port 317 enables air to enter into the second reservoir chamber 340. Each of the first and second air ports 316, 317 are one-way air valves. Thus, upon compressing the housing 310 to deliver the first and second oral care materials 331, 341, air will enter into each of the first and second reservoir chambers 330, 340 so that the housing 310 can retain its shape. This enables the dispenser 300 to remain sized and configured to fit within the cavity 240 of the handle 210 even after dispensing of some or all of the first and second oral care materials 331, 341. In certain embodiments, the housing 310 of the dispenser 300 is formed of any number of polymeric materials such as polypropylene, polyethylene, polycarbonate, or other materials that prove to be compatible with the oral care material stored therein.

Referring now to FIGS. 4A and 4B, an alternative embodiment of a dispenser 400 that can be used with the oral care system 100 will be described. The dispenser 400 is an alternative embodiment to the dispenser 300 that has been described in detail above. Thus, in certain embodiments the oral care system 100 can include the toothbrush 200 and the dispenser 300, and in other embodiments the oral care system 100 can include the toothbrush 200 and the dispenser 400. Similar features of the dispenser 400 will be similarly numbered to the dispenser 300 except that the 400-series of numbers will be used. Certain features of the dispenser 400 will not be described in detail below in the interest of brevity. In such instances, it should be appreciated that the descriptions of those similar features of the dispenser 300 equally apply to the dispenser 400.

The dispenser 400 has a housing 410 that is similar in size and shape to the housing 310 of the dispenser 300. Thus, the dispenser 400 can similarly be detachably coupled to the toothbrush 200 in the manner that has been described in detail above. The dispenser 400 comprises a first reservoir chamber 430 and a second reservoir chamber 440. The first reservoir chamber 430 contains a first oral care material 431 and the second reservoir chamber 440 contains a second oral care material 441. Furthermore, the dispenser 400 comprises a mixing chamber 450. First and second air ports 416, 417 are formed into the housing 410 and operate similar to the first and second air ports 316, 317 discussed above.

In the exemplified embodiment, the mixing chamber 450 comprises a tubular section 451 and a dispensing section 452. The tubular section 451 is defined by a tubular separator wall 405. In the exemplified embodiment, the tubular separator wall 405 is formed integrally with the housing 410. However, the tubular separator wall 405 can be separately formed from the housing 410 in other embodiments. A pair of divider walls 406 extends from the tubular separator wall 405 to opposing sides of the housing 410 to complete separation of the first reservoir chamber 430 from the second reservoir chamber 440. Thus, the first and second reservoir chambers 430, 440 extend longitudinally adjacent to one another, but are isolated from one another by the combination of the tubular separator wall 405 and the pair of divider walls 406. In certain embodiments, the first and second reservoir chambers 430, 440 collectively circumferentially surround the tubular section 451 of the mixing chamber 450. However, the invention is not to be so limited in all embodiments.

The tubular section 451 of the mixing chamber 450 is in fluid communication with the dispensing section 452 of the mixing chamber 450. In the exemplified embodiment, the tubular section 451 of the mixing chamber 450 has a substantially constant cross-sectional area. However, the dispensing section 452 of the mixing chamber 450 has a cross-sectional area that tapers and decreases as it extends axially from the tubular section 451 of the mixing chamber 450 to the applicator 460. The cross-sectional area of the dispensing section 452 is greater than the cross-sectional area of the tubular section 451 at a location where the tubular section 451 and the dispensing section 452 are in fluid communication with one another (i.e., at the top of the tubular section 451 and the bottom of the dispensing section 452).

A mixing screw 470 is disposed within the mixing chamber 450. More specifically, in the exemplified embodiment the mixing screw 470 is disposed within the tubular section 451 of the mixing chamber 450. The mixing screw 470 can be formed of any desired materials, including rigid plastics, elastomeric materials, metals or the like. An actuator 471 is operably coupled to the mixing screw 470 for rotating the mixing screw 470 within the tubular section 451 of the mixing chamber 450. The actuator 471 protrudes from a bottom surface 407 of the housing 410 so that the actuator 471 can be gripped and rotated by a user. The mixing screw 470 facilitates ensuring that the first oral care material 431 and the second oral care material 441 are adequately mixed together to form a mixture within the mixing chamber 450 prior to dispensing the mixture of the first and second oral care materials 431, 441 into a user's oral cavity.

The tubular section 451 of the mixing chamber 450, and hence also the mixing screw 470, extend along a longitudinal axis C-C of the dispenser 400. The first and second reservoir chambers 430, 440 are located longitudinally adjacent to the mixing screw 470. Furthermore, the mixing screw 470 is circumferentially surrounded by a combination of the first and second reservoir chambers 430, 440. In the exemplified embodiment, a first delivery port 434 is formed into and extends through the tubular separator wall 405 in a region between the first reservoir chamber 430 and the tubular section 451 of the mixing chamber 450. Similarly, a second delivery port 444 is formed into and extends through the tubular separator wall 405 in a region between the second reservoir chamber 440 and the tubular section 451 of the mixing chamber 450. The first delivery port 434 is a one-way flow controller that enables the first oral care material 431 to flow from the first reservoir chamber 430 into the tubular section 451 of the mixing chamber 450 while preventing the first oral care material 431 from flowing back from the tubular section 451 of the mixing chamber 450 into the first reservoir chamber 430. Similarly, the second delivery port 444 is a one-way flow controller that enables the second oral care material 441 to flow from the second reservoir chamber 440 into the tubular section 451 of the mixing chamber 450 while preventing the second oral care material 441 from flowing back from the tubular section 451 of the mixing chamber 450 into the second reservoir chamber 440.

During use of the dispenser 400, a user rotates the mixing screw 470 by rotating the actuator 471 that is operably coupled to the mixing screw 470. As noted above, the actuator 471 is accessible to a user due to its protrusion beyond the bottom surface 407 of the housing 410. Rotating the mixing screw 470 creates a siphon effect that causes the first oral care material 431 to flow from the first reservoir chamber 430 through the first delivery port 434 and into the tubular section 451 of the mixing chamber 450. Furthermore, rotating the mixing screw 470 also causes the second oral care material 441 to flow from the second reservoir chamber 440 through the second delivery port 444 and into the tubular section 451 of the mixing chamber 450. As a result, the first and second oral care materials 431, 441 are intermixed together within the tubular section 451 of the mixing chamber 450. Thus, rotating the mixing screw 470 draws the first and second oral care materials 431, 441 into the tubular section 451 of the mixing chamber 450 via the first and second delivery ports 434, 444, respectively, and expels the mixture of the first and second oral care materials 431, 441 from the dispensing nozzle 460. Furthermore, due to its helical structure, the mixing screw 470 also increases the degree to which the first and second oral care materials 431, 441 are mixed.

In the exemplified embodiment, the first and second delivery ports 434, 444 are located in a bottom portion of the tubular section 451 of the mixing chamber 450. Thus, during dispensing of the first and second oral care materials 431, 441 (i.e., during rotation of the mixing screw 470), the first and second oral care materials 431, 441 flow from their respective reservoir chambers into the bottom portion of the mixing chamber 450. More specifically, the first and second oral care materials 431, 441 flow into the bottom of the tubular section 451 of the mixing chamber, through the entire axial length of the tubular section 451 of the mixing chamber 450, into the delivery section 452 of the mixing chamber 450, and through the dispensing passageway 461 located within the dispensing nozzle 460.

The first and second oral care materials 431, 441 flow in a downward axial direction from their respective reservoir chambers 430, 440 into the tubular section 451 of the mixing chamber 450, and then the first and second oral care materials 431, 441 flow in an upward axial direction (opposite to the downward axial direction) through the tubular section 451 of the mixing chamber 450 until being dispensed. The first and second delivery ports 434, 444 deliver the first and second oral care materials 431, 441 to the bottom portion of the mixing chamber 450 and the dispensing nozzle 460 dispenses the mixture of the first and second oral care materials 431, 441 from a top portion of the mixing chamber 450. The mixing screw 470 forms a helical path, which further facilitates the mixing of the first and second oral care materials 431, 441 together. As a result, upon reaching the delivery section 452 of the mixing chamber 450, the first and second oral care materials 431, 441 have already been thoroughly mixed within the tubular section 451 of the mixing chamber 450 and are ready to be dispensed onto a user's teeth and other oral surfaces.

Figure 5:
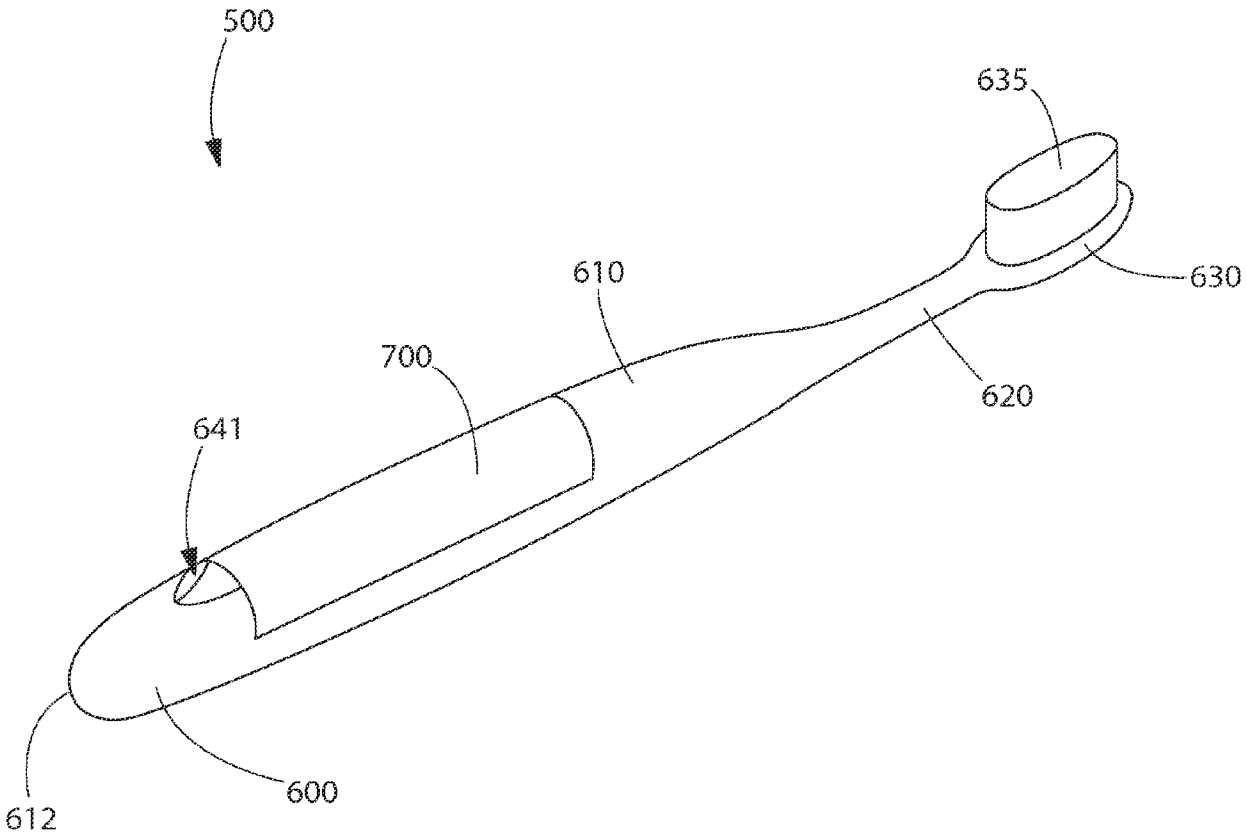
FIG. 5 is a front perspective view of an alternative embodiment of an oral care system including a toothbrush and an oral agent dispenser according to an embodiment of the present invention.
Figure 6:
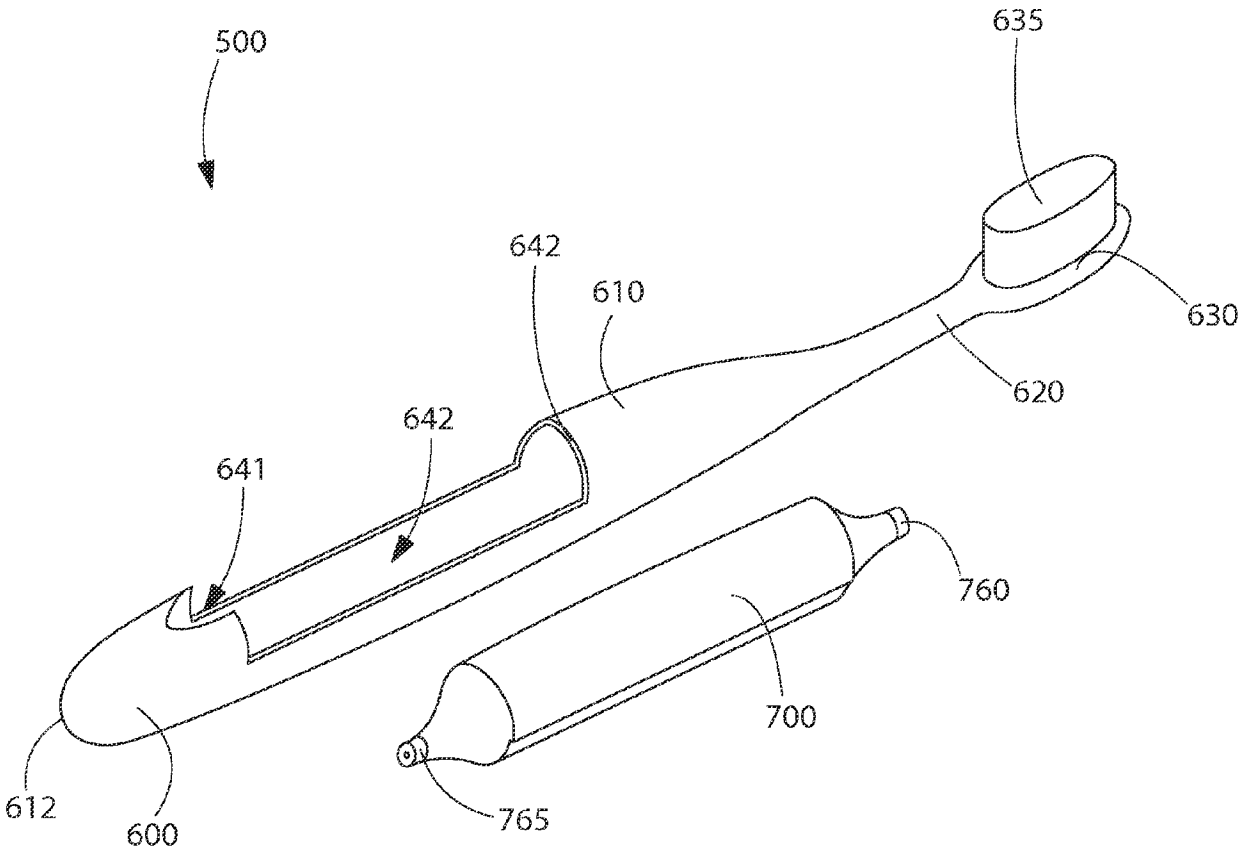
FIG. 6 is an exploded view of the oral care system of FIG. 5 wherein the oral agent dispenser is detached from the toothbrush.

Referring now to FIGS. 5 and 6 concurrently, a second embodiment of an oral care system 500 will be described. The oral care system 500 is similar to the oral care system 100 described above, and thus features in the oral care system 500 that are similar to features of the oral care system 100 will be similarly numbered.

The oral care system 500 generally includes a toothbrush 600 and a dispenser 700. The toothbrush 600 is similar to the toothbrush 200 described above with reference to FIGS. 1 and 2, with the following exceptions discussed herein below. It should be appreciated that the description of features of the toothbrush 600 that are similar to the toothbrush 200 may be omitted, it being understood that the description those features of the toothbrush 200 apply equally to the toothbrush 600.

The toothbrush 600 comprises a handle 610, a neck 620 and a head 630 having tooth cleaning elements 635 extending therefrom. Furthermore, the handle 610 of the toothbrush 600 includes a cavity or depression 640 within which the dispenser 700 nests when the dispenser 700 is detachably coupled to the handle 600. However, the handle 610 further comprises an open channel 641 extending longitudinally from the cavity or depression 640 in a direction towards the proximal end 612 of the handle 610. Of course, the invention is not to be so limited and in other embodiments the open channel 641 can extend from the cavity 640 in a direction towards the head 630 of the toothbrush 600.

The external structure of the housing 710 of the dispenser 700 is similar to the dispenser 300 discussed above, except that the dispenser 700 comprises a first dispensing nozzle 760 and a second dispensing nozzle 765 such that the first and second dispensing nozzles 760, 765 are located on opposite ends of the dispenser 700. Thus, the open channel 641 extending from the cavity 640 provides a region on the handle 610 within which the second dispensing nozzle 765 of the dispenser 700 can nest when the dispenser 700 is detachably coupled to the toothbrush 600.

The dispenser 700 is attached to the handle 610 of the toothbrush 600 in a similar manner to the attachment of the dispenser 300 to the handle 210 of the toothbrush 200 discussed above. Specifically, the first dispensing nozzle 760 is first placed within the cavity 640 and axially translated until the first dispensing nozzle 760 is positioned within the cavity 640 and protrudes beyond a top end 642 of the cavity 640. In this manner, the first dispensing nozzle 760 is protected against damage by the handle 610 due to the first dispensing nozzle 760 not being exposed, but rather being fully surrounded by the handle 610, when the dispenser 700 is detachably coupled to the handle 610 of the toothbrush 600. Next, the dispenser 700 is translated into the cavity 640 until the second dispensing nozzle 765 of the dispenser 700 nests within the open channel 641. In the exemplified embodiment, at least a portion of the second dispensing nozzle 765 is exposed when the dispenser 700 is detachably coupled to the handle 610 of the toothbrush 600. Thus, the open channel 641 provides a nesting location for the second dispensing nozzle 765 of the dispenser 700.

Figure 7:
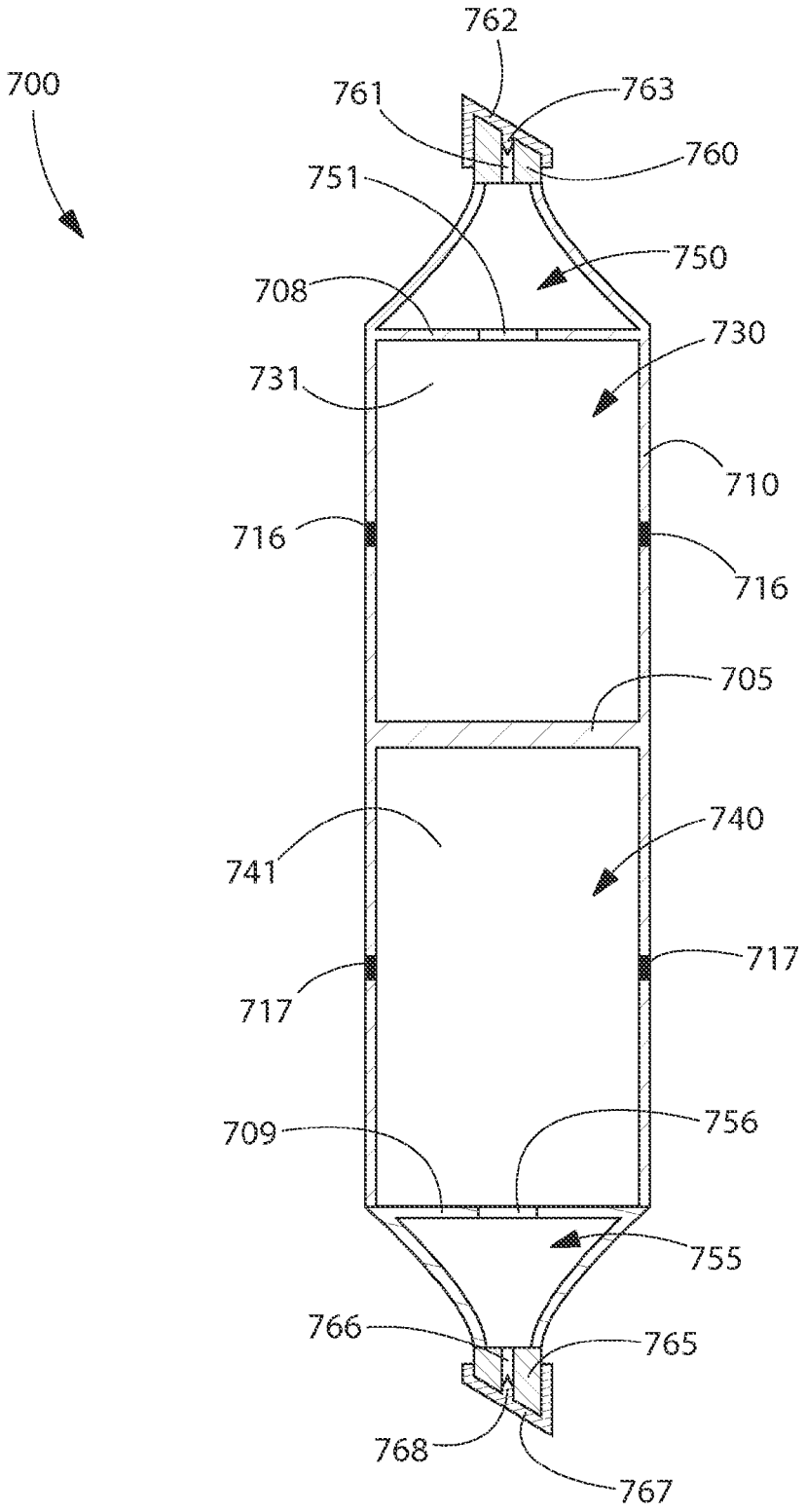
FIG. 7 is a longitudinal cross-sectional view of the oral agent dispenser of FIG. 6 according to a first embodiment of the present invention.
Figure 8:
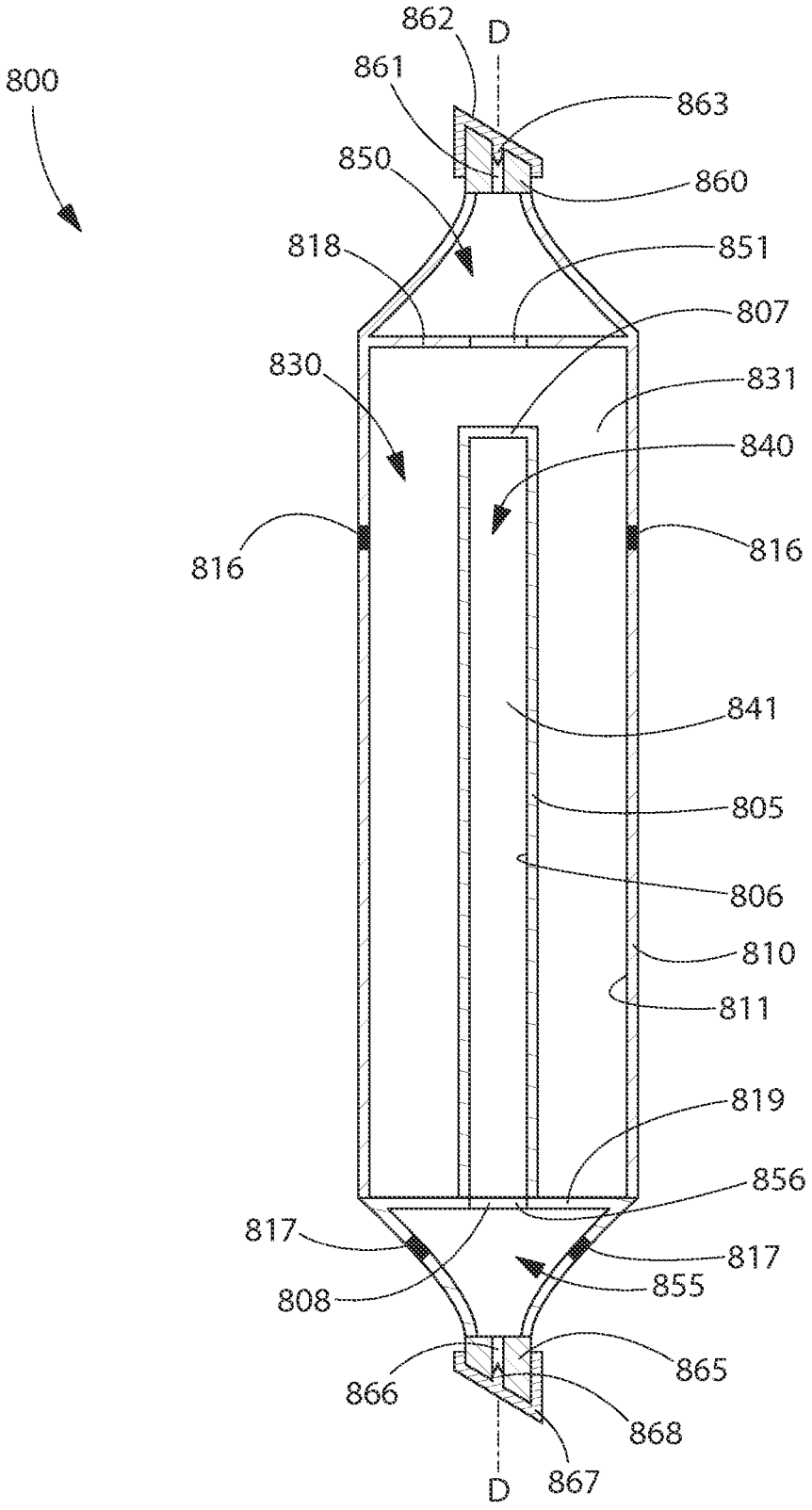
FIG. 8 is a longitudinal cross-sectional view of the oral agent dispenser of FIG. 6 according to a second embodiment of the present invention.
Figure 9:
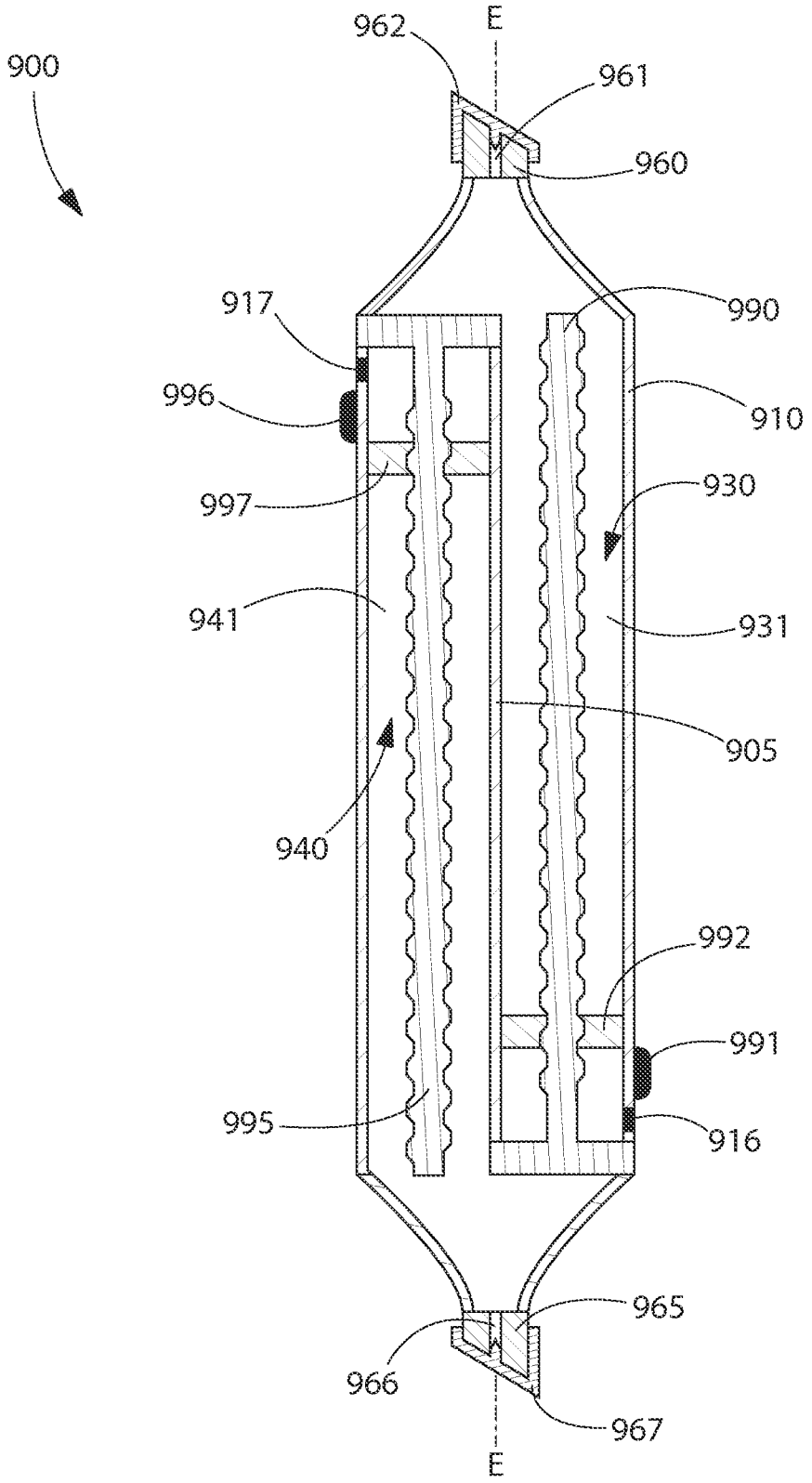
FIG. 9 is a longitudinal cross-sectional view of the oral agent dispenser of FIG. 6 according to a third embodiment of the present invention.

The dispenser 700 can take on several different embodiments and structural configurations. Specifically, FIG. 7 illustrates the dispenser 700 having a first structural configuration, FIG. 8 illustrates a dispenser 800 having a second structural configuration and FIG. 9 illustrates a dispenser having a third structural configuration. Any of the dispensers 700, 800, 900 can be used with the oral care system 500. The dispensers 700, 800, 900 each have two nozzles, and thus the oral care materials stored therein do not mix during storage, but rather can be mixed when applied as two separate applications. The oral care materials stored in these dispensers can be used for two different treatments that are not intended to mix as well, such as for example without limitation a whitening treatment and a sensitivity treatment.

Referring to FIG. 7, the dispenser 700 will be further described. The dispenser 700 comprises a housing 710 having a transverse separator wall 705 that axially divides the dispenser 700 into a top half and a bottom half. Each of the top and bottom halves of the dispenser 700 is identical, rendering the dispenser 700 substantially symmetrical about the transverse separator wall 705. The dispenser 700 comprises a first reservoir chamber 730 located in the top half of the dispenser 700 and a second reservoir chamber 740 located in the bottom half of the dispenser 700. In the exemplified embodiment, the first and second reservoir chambers 730, 740 are axially aligned with one another. The first reservoir chamber 730 is isolated and separated from the second reservoir chamber 740 by the transverse separator wall 705. The first reservoir chamber 730 stores a first oral care material 731 and the second reservoir chamber 740 stores a second oral care material 741. In certain embodiments, the first and second oral care materials 731, 741 are different. The transverse separator wall 705 prevents the first and second oral care materials 731, 741 from mixing within the housing 710 of the dispenser 700. Furthermore, because the dispenser 700 comprises a first dispensing nozzle 765 and a second dispensing nozzle 765, the first and second oral care materials 731, 741 are also not mixed during dispensing. Stated another way, the first and second oral care materials 731, 741 are not mixed within the dispenser 700 either during storage or dispensing.

In the exemplified embodiment, the housing 710 comprises one or more air ports 716 that provide a one-way passageway from the external environment into the first reservoir chamber 730. Furthermore, the housing 710 comprises one or more air ports 717 that provide a one-way passageway from the external environment into the second reservoir chamber 740. In the exemplified embodiment, there are two of the air ports 716 and two of the air ports 717, although more or less than two air ports can be used. The air ports 716, 717 enable the housing 710 of the dispenser 700 to maintain its general shape even after an amount of the first and/or second oral care materials 731, 741 has been expelled from the housing 710 to enable the dispenser 700 to still be detachably coupled to the toothbrush 600. Specifically, the air ports 716, 717 enable air to enter into the first and second reservoir chambers 730, 740 as the first and second oral care materials 731, 741 become depleted from the first and second reservoir chambers 730, 740.

The dispenser 700 further comprises a first dispensing chamber 750 that is in fluid communication with the first reservoir chamber 730 and a second dispensing chamber 755 that is in fluid communication with the second reservoir chamber 740. The first reservoir chamber 730 is separated from the first dispensing chamber 750 by a first transverse wall 708. A first opening 751 is formed into the first transverse wall 708 and forms a passageway that extends between the first reservoir chamber 730 and the first dispensing chamber 750. The second reservoir chamber 740 is separated from the second dispensing chamber 755 by a second transverse wall 709. A second opening 756 is formed into the second transverse wall 709 and forms a passageway that extends between the second reservoir chamber 740 and the second dispensing chamber 755. In certain embodiments, the housing 710 is compressible so that the first and second oral care materials 731, 741 can be expelled from the first and second reservoir chambers 730, 740, respectively, by squeezing and compressing the housing. In certain embodiments, the material that makes up the housing 710 is not limiting of the present invention so long as the housing 710 can be compressed.

As noted above, a first dispensing nozzle 760 extends axially from the first dispensing chamber 750 in a direction away from the first dispensing chamber 750. Similarly, a second dispensing nozzle 765 extends axially away from the second dispensing chamber 755 in a direction away from the second dispensing chamber 755. A first dispensing passageway 761 extends through the first dispensing nozzle 760 from the first dispensing chamber 750 to an opening that enables the first oral care material 731 to be dispensed. A second dispensing passageway 766 extends through the second dispensing nozzle 765 from the second dispensing chamber 755 to an opening that enables the second oral care material 741 to be dispensed.

Furthermore, a first cap 762 is removably coupled to the dispenser 700 to seal the first nozzle 760 and a second cap 767 is removably coupled to the dispenser 700 to seal the second nozzle 765. More specifically, the first cap 762 comprises a seal portion 763 that protrudes into the first dispensing passageway 761 when the first cap 762 is coupled to the dispenser 700. The second cap 767 comprises a seal portion 768 that protrudes into the second dispensing passageway 766 when the second cap 767 is coupled to the dispenser 700.

When it is desired to dispense one of the first or second oral care materials 731, 741 from the dispenser 700, the first and second caps 762, 767 must first be removed. More specifically, when it is desired to dispense the first oral care material 731 from the first reservoir chamber 730, the first cap 762 is removed from the first nozzle 760. Then, the portion of the housing 710 surrounding the first reservoir chamber 730 is squeezed or compressed so that the first oral care material 731 is expelled from the first reservoir chamber 730 by passing through the first opening 751 and into the first dispensing chamber 750, and then passing through the first dispensing passageway 761. Similarly, when it is desired to dispense the second oral care material 741 from the second reservoir chamber 740, the second cap 767 is removed from the second nozzle 765. Then, the portion of the housing 710 surrounding the second reservoir chamber 740 is squeezed or compressed so that the second oral care material 741 is expelled from the second reservoir chamber 740 by passing through the second opening 756 and into the second dispensing chamber 755, and then passing through the second dispensing passageway 766.

In certain embodiments, it may be desirable to only remove one of the first or second caps 762, 767 at a time to prevent simultaneous dispensing of both of the oral care materials 731, 741. If only one of the first or second caps 762, 767 is removed and then the housing 710 is squeezed or compressed, only one of the first or second oral care materials 731, 741 will be expelled from the dispenser 700 because the other one of the first or second oral care materials 731, 741 will be prevented from expulsion from the dispenser 700 due to its respective cap 762, 767 blocking the passageway.

The dispenser 700 can be used when it is desirable to have the ability to dispense two different oral care materials into a user's oral cavity separately. Thus, using the dispenser 700 the first and second oral care materials 731, 741 are not mixed, but are maintained separately and dispensed separately. In certain embodiments, the first and second oral care materials 731, 741 can be dispensed sequentially into a user's oral cavity and can be mixed upon application into the user's oral cavity.

Referring now to FIG. 8, an alternative embodiment of a dispenser 800 will be described. The dispenser 800 is similar to the dispenser 700 in many respects, and thus in the interest of brevity only those features of the dispenser 800 that are different from the dispenser 700 will be discussed in detail below. Certain features of the dispenser 800 that are the same as features of the dispenser 700 will be similarly numbered except that the 800-series of numbers will be used. It should be appreciated that to the extent that certain numbered features are not described in detail below, the description of those features above with respect to the dispenser 700 shall apply.

Similar to the dispenser 700, the dispenser 800 has a first dispensing nozzle 860 and a second dispensing nozzle 865, such that the first and second dispensing nozzles 860, 865 are located on opposite ends of the dispenser 800. Thus, the dispenser 800 can be used in place of the dispenser 700 and detachably coupled to the toothbrush 600 in the oral care system 500. The dispenser 800 comprises a first reservoir chamber 830 containing a first oral care material 831 and a second reservoir chamber 840 containing a second oral care material 841. In certain embodiments, the first and second oral care materials 831, 841 are different. However, the invention is not to be so limited in all embodiments and in certain other embodiments each of the first and second oral care materials 831, 841 can be the same.

The dispenser 800 comprises a housing 810 and extends from the first dispensing nozzle 860 to the second dispensing nozzle 865 along a longitudinal axis D-D. The housing 810 has an inner surface 811 that defines the first reservoir chamber 830. Furthermore, the dispenser 800 includes a separator wall 805 that isolates the first and second reservoir chambers 830, 840 from one another. In the exemplified embodiment, the separator wall 805 is a tubular wall having an inner surface 806 that defines the second reservoir chamber 840. The tubular wall 805 has a first closed end 807 and a second open end 808. Furthermore, the first reservoir chamber 830 circumferentially surrounds the second reservoir chamber 840. Thus, the second reservoir chamber 840 is essentially entirely contained within the first reservoir chamber 830 and is separated and isolated from the first reservoir chamber 830 by the separator wall 805. In the exemplified embodiment, the second reservoir chamber 840 extends along the longitudinal axis D-D of the dispenser 800.

The dispenser 800 further comprises a first dispensing chamber 850 that is in fluid communication with the first reservoir chamber 830 and a second dispensing chamber 855 that is in fluid communication with the second reservoir chamber 840. A first transverse wall 818 separates the first reservoir chamber 830 from the first dispensing chamber 850 and a second transverse wall 819 separates the second reservoir chamber 840 from the second dispensing chamber 855. A first opening 851 is formed into the first transverse wall 818 to enable the first oral care material 831 to flow from the first reservoir chamber 830 into the first dispensing chamber 850. Furthermore, a second opening 856 is formed into the second transverse wall 819 to enable the second oral care material 841 to flow from the second reservoir chamber 840 into the second dispensing chamber 855.

The first dispensing nozzle 860 extends from the first dispensing chamber 850 in an axial direction away from the first dispensing chamber 850. A dispensing passageway 861 is formed into and extends through the first dispensing nozzle 860 from the first dispensing chamber 850 to the external environment to facilitate dispensing of the first oral care material 831. The second dispensing nozzle 865 extends from the second dispensing chamber 855 in an axial direction away from the second dispensing chamber 855. A dispensing passageway 866 is formed into and extends through the second dispensing nozzle 865 from the second dispensing chamber 855 to the external environment to facilitate dispensing of the second oral care material 841 onto the toothbrush 500 or into a user's oral cavity.

A first cap 862 is removably coupled to the dispenser 800 to seal the first nozzle 860 and a second cap 867 is removably coupled to the dispenser 800 to seal the second nozzle 865. More specifically, the first cap 862 comprises a seal portion 863 that protrudes into the first dispensing passageway 861 when the first cap 862 is coupled to the dispenser 800. The second cap 867 comprises a seal portion 868 that protrudes into the second dispensing passageway 866 when the second cap 867 is coupled to the dispenser 800.

In certain embodiments, the housing 810 and the separator wall 805 are compressible. The housing 810 and the separator wall 805 are not limited to any specific materials, so long as the material enables the housing 810 and the separator wall 805 to be compressed to facilitate dispensing of the first and second oral care materials 831, 841. When it is desired to dispense the first oral care material 830 from the dispenser 800, the first cap 862 is removed from the dispenser 800 so that the first dispensing passageway 861 is no longer blocked by the seal portion 863 of the first cap 862. Then, the housing 810 is squeezed or compressed so that the first oral care material 831 flows from the first reservoir chamber 830 through the first opening 851 in the first transverse wall 818 and into the first dispensing chamber 850. Continued squeezing or compression of the housing 810 causes the first oral care material 831 to continue to flow through the first dispensing passageway 861 and out of the dispenser 800 for application to a user's oral cavity.

During dispensing of the first oral care material 831 from the dispenser 800, the second cap 867 may remain coupled to the second nozzle 865, or the second cap 867 may be removed from the second nozzle 865. Specifically, because the first reservoir chamber 830 circumferentially surrounds the second reservoir chamber 840, squeezing or compression of the housing 810 will not necessarily result in the second oral care material 841 being dispensed, regardless of whether or not the second cap 867 is coupled to the second nozzle 865.

When it is desired to dispense the second oral care material 841 only, the second cap 867 is removed from the second nozzle 865 and the first cap 862 remains coupled to the first nozzle 860. Specifically, if the first cap 862 is removed from the first nozzle 860, the first oral care material 831 will be significantly depleted before any of the second oral care material 841 will be able to be dispensed from the dispenser 800 due to the first reservoir chamber 830 circumferentially surrounding the second reservoir chamber 840. Thus, by maintaining the first cap 862 on the first dispensing nozzle 860 and removing the second cap 867 from the second dispensing nozzle 865 and then squeezing or compressing the housing 810, the second oral care material 841 is dispensed from the dispenser 800 while the first oral care material 831 remains contained within the first reservoir chamber 830 and is not dispensed. Specifically, squeezing or compressing the housing 810 when the first cap 862 is coupled to the first dispensing nozzle 850 and when the second cap is removed from the second dispensing nozzle 855 results in the tubular separator wall 805 also being compressed, which causes the second oral care material 841 to flow from the second reservoir chamber 840, through the second opening 856, into the second dispensing chamber 855, through the second dispensing passageway 866, and into the user's oral cavity (or onto the toothbrush 500 as desired).

Furthermore, the housing 810 comprises one or more air ports 816 that provide a one-way passageway from the external environment into the first reservoir chamber 830. The housing 810 also comprises one or more air ports 817 that provide a one-way passageway from the external environment into the second reservoir chamber 840. The air ports 816, 817 enable the housing 810 and the tubular separator wall 805 to maintain their general shape even after an amount of the first and/or second oral care materials 831, 841 has been expelled from the dispenser 800. This enables the dispenser 800 to be capable of detachably coupling to the toothbrush 500 regardless of the volume of its contents.

Referring now to FIG. 9, the dispenser 900 will be described. Features of the dispenser 900 that are similar to the dispensers 700, 800 described above will be similarly numbered except that the 900-series of numbers will be used. The dispenser 900 extends along a longitudinal axis E-E and comprises a housing 910 having a first reservoir chamber 930 containing a first oral care material 931 and a second reservoir chamber 940 containing a second oral care material 941. The first and second reservoir chambers 930, 940 are located within the housing 910 longitudinally adjacent to one another. Furthermore, the first and second reservoir chambers 930, 940 are separated and isolated from one another by a separator wall 905. The separator wall 905 maintains the first and second reservoir chambers 930, 940 as isolated chambers so that the first and second oral care materials 931, 941 do not mix with one another either during storage or dispensing within the dispenser 900.

The dispenser 900 further comprises a first nozzle 960 for dispensing the first oral care material 931 from the first reservoir chamber 930 and a second nozzle 965 for dispensing the second oral care material 941 from the second reservoir chamber 940. The first and second nozzles 960, 965 are located on opposite ends of the dispenser 900. A first dispensing passageway 961 extends through the first nozzle 960 and a second dispensing passageway 966 extends through the second nozzle 965. Furthermore, a first cap 962 is removably coupled to the first nozzle 960 and a second cap 967 is removably coupled to the second nozzle 965. The first cap 962 seals the first nozzle 960 and prevents the first oral care material 931 from being dispensed and the second cap 967 seals the second nozzle 965 and prevents the second oral care material 941 from being dispensed.

The dispenser 900 further comprises a first elevator screw 990 located within the first reservoir chamber 930 and a second elevator screw 995 located within the second reservoir chamber 940. The first elevator screw 990 is operably coupled to a first actuator 991 and the second elevator screw 995 is operably coupled to a second actuator 996. In the exemplified embodiment, each of the first and second actuators 991, 996 are illustrated as a button. Thus, in the exemplified embodiment depressing the first actuator 991 causes the first elevator screw 990 to rotate and depressing the second actuator 996 causes the second elevator screw 995 to rotate. However, the invention is not to be so limited in all embodiments and in certain other embodiments each of the first and second actuators 991, 996 can take on other forms, such as being manually rotatable discs or any other type of mechanism that can impart rotational movement onto the first and second elevator screws 990, 995.

The first elevator screw 990 is also operably coupled to a first elevator platform 992 and the second elevator screw 995 is operably coupled to a second elevator platform 997. Thus, when the first actuator 991 is actuated, the first elevator screw 990 is rotated and the first elevator platform 992 is advanced along the first elevator screw 990. More specifically, when the first elevator screw 990 is rotated, the first elevator platform 992 advances along the first elevator screw 990 in a first axial direction towards the first nozzle 960. Thus, when it is desired to dispense the first oral care material 931 from the first reservoir chamber 930, the first cap 962 is removed from the first nozzle 960 and the first actuator 991 is actuated. As a result, the first elevator platform 992 moves axially along the first elevator screw 990 and forces the first oral care material 931 stored within the first reservoir chamber 930 to flow towards the first nozzle 960 and through the first dispensing passageway 961.

When the second actuator 996 is actuated, the second elevator screw 995 is rotated and the second elevator platform 997 is advanced along the second elevator screw 995. More specifically, when the second elevator screw 995 is rotated, the second elevator platform 997 advances along the second elevator screw 995 in a second axial direction (which is opposite the first axial direction) towards the second nozzle 965. Thus, when it is desired to dispense the second oral care material 941 from the second reservoir chamber 940, the second cap 967 is removed from the second nozzle 965 and the second actuator 996 is actuated. As a result, the second elevator platform 997 moves axially along the second elevator screw 995 and forces the second oral care material 941 stored within the second reservoir chamber 940 to flow towards the second nozzle 965 and through the second dispensing passageway 966.

In certain embodiments, a single actuation of the actuator 991, 996 (such as by depressing an actuator button, completing a full rotation of an actuator disc, etc.) results in a single dose of the oral care material being delivered. In this manner, dosage of the oral care material contained within the dispenser 900 can be controlled.

Moreover, the housing 910 also comprises a first air port 916 that provides an air passageway from the external environment into the first reservoir chamber 930 and a second air port 917 that provides an air passageway from the external environment into the second reservoir chamber 940. As has been described above with regard to the other embodiments the first and second air ports 916, 917 enable air to enter into the first and second reservoir chambers 930, 940, which assists in ensuring that the housing 910 maintains its shape so that it can be detachably coupled to the toothbrush 500.

In certain embodiments, each of the dispensers discussed herein above can be made to be refillable. Specifically, each of the dispensers can include a refill port so that the oral care materials can be refilled into the dispenser upon depletion of the same. In still other embodiments the dispensers may contain an amount of the oral care materials that is intended to be used during the life-cycle of the toothbrush to which it is detachably coupled. Thus, upon depletion of the oral care materials contained within the dispenser, a user will know that it is also time to replace his or her toothbrush.

Several embodiments of dispensers have been disclosed herein above. It should be appreciated that various components and structures of the various dispensers can be combined and interchanged within the scope of the present invention.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care system comprising:

a toothbrush comprising a handle, a head and a plurality of tooth cleaning elements extending from the head; and a dispenser detachably coupled to the toothbrush, the dispenser comprising:

a housing;

a first reservoir chamber disposed in the housing containing a first oral care material;

a second reservoir chamber disposed in the housing containing a second oral care material, the second oral care material different than the first oral care material;

a mixing chamber disposed in the housing;

a first delivery port for introducing the first oral care material into the mixing chamber from the first reservoir chamber;

a second delivery port for introducing the second oral care material into the mixing chamber from the second reservoir chamber, and a dispensing nozzle for dispensing a mixture of the first and second oral care materials.

2. The oral care system according to claim 1 wherein each of the first and second delivery ports comprises a one way flow controller for preventing backflow from the mixing chamber.

3. The oral care system according to claim 1 wherein the first and second delivery ports deliver the first and second oral care materials to a bottom portion of the mixing chamber and the nozzle dispenses the mixture of the first and second oral care materials from a top portion of the mixing chamber.

4. The oral care system according to claim 1 wherein the dispenser further comprises a mixing screw disposed within the mixing chamber and an actuator for rotating the mixing screw.

5. The oral care system according to claim 4 wherein rotation of the mixing screw draws the first and second oral care materials into the mixing chamber via the first and second delivery ports respectively and expels the mixture of the first and second oral care materials from the nozzle.

6. The oral care system according to claim 5 wherein the first and second reservoir chambers are longitudinally adjacent to the mixing screw.

7. The oral care system according to claim 6 wherein the mixing screw extends along a longitudinal axis of the dispenser and the mixing chamber is circumferentially surrounded by the first and second reservoir chambers.

8. The oral care system according to claim 4 wherein the mixing screw forms a helical mixing path within the mixing chamber, the first and second delivery ports delivering the first and second oral care materials into the helical mixing path.

9. The oral care system according to claim 4 wherein the mixing chamber comprises a tubular section in which the mixing screw nests, wherein the tubular section is defined by a tubular separator wall, the first and second delivery ports extending through the tubular separator wall.

10. The oral care system according to claim 1 wherein at least a first portion of the dispenser nests within a cavity formed in the handle of the toothbrush when the dispenser is detachably coupled to the toothbrush.

11. The oral care system according to claim 1 wherein the handle comprises a depression, the dispenser nesting in the depression to form a portion of the handle when the dispenser is detachably coupled to the toothbrush.

12. The oral care system according to claim 11 wherein the handle further comprises an open channel extending longitudinally from the depression, a first portion of the dispenser nesting within the open channel when the dispenser is detachably coupled to the toothbrush.

13. An oral care system comprising:

a toothbrush comprising a handle, a head and a plurality of tooth cleaning elements extending from the head; and a dispenser detachably coupled to the toothbrush, the dispenser comprising:

a housing;

a first reservoir chamber disposed in the housing containing a first oral care material;

a second reservoir chamber disposed in the housing containing a second oral care material, the second oral care material different than the first oral care material;

a first nozzle for dispensing the first oral care material from the first reservoir chamber; and a second nozzle for dispensing the second oral care material from the second reservoir chamber, and a separator wall that isolates the first and second reservoir chambers from one another;

wherein the first and second nozzles are located on opposite ends of the dispenser.

14. The oral care system according to claim 13 wherein the first and second reservoir chambers are axially aligned with one another.

15. The oral care system according to claim 13 wherein the first reservoir chamber circumferentially surrounds the second reservoir chamber.

16. The oral care system according to claim 15 wherein the separator wall is a tubular wall having a closed end and an open end, the open end in fluid communication with the second nozzle.

17. The oral care system according to claim 15 wherein the housing and the separator wall are compressible.

18. An oral care system comprising:

a toothbrush comprising a handle, a head and a plurality of tooth cleaning elements extending from the head; and a dispenser detachably coupled to the toothbrush, the dispenser comprising:

a housing;

a first reservoir chamber disposed in the housing containing a first oral care material;

a second reservoir chamber disposed in the housing containing a second oral care material, the second oral care material different than the first oral care material;

a first nozzle for dispensing the first oral care material from the first reservoir chamber;

a second nozzle for dispensing the second oral care material from the second reservoir chamber, and a separator wall that isolates the first and second reservoir chambers from one another;

a first elevator screw located in the first reservoir chamber;

a second elevator screw located in the second reservoir chamber;

a first actuator for rotating the first elevator screw to advance a first elevator platform along the first elevator screw; and a second actuator for rotating the second elevator screw to advance a second elevator platform along the second elevator screw.

* * * * *